US005816562A

United States Patent [19]

Stockton et al.

[11] Patent Number: 5,816,562

[45] Date of Patent: Oct. 6, 1998

[54] SAND JACK APPARATUS

[75] Inventors: Dennis Stockton, Woodlands; Howard C. Gueldner, New Brauufels, both of Tex.

[73] Assignee: Symons Corporation, Des Plaines, Ill.

[21] Appl. No.: 730,498

[22] Filed: Oct. 11, 1996

[51] Int. Cl.[6] ..... B66F 3/36

[52] U.S. Cl. ..... 254/100; 254/133

[58] Field of Search ..... 220/573, 571, 220/661; 254/100, 133, 98, DIG. 4; 472/126

[56] References Cited

U.S. PATENT DOCUMENTS

| | | | |
|---|---|---|---|
| 3,222,030 | 12/1965 | Thorpe | 254/100 |
| 3,655,161 | 4/1972 | Schuelen | 254/100 |
| 3,827,595 | 8/1974 | Reynolds | 220/661 |
| 4,632,268 | 12/1986 | Melzi et al. | 220/573 |
| 4,817,935 | 4/1989 | Varga | 472/126 |

OTHER PUBLICATIONS

1986 Webster's *Third New International* Dictionary, s.v. "sand jack.".

*Primary Examiner*—Robert C. Watson
*Attorney, Agent, or Firm*—Marshall, O'Toole, Gerstein, Murray & Borun

[57] ABSTRACT

A sand jack having a box containing sand and a lid are joined to a screw jack and both temporarily support a structure. When it is desired to remove the screw jack, sand is released from the box to reduce loading on the screw jack and enable the screw jack to be removed or to allow the nut on the screw jack to be rotated.

13 Claims, 3 Drawing Sheets

SAND JACK APPARATUS

FIELD AND BACKGROUND OF THE INVENTION

This invention relates generally to temporary supports for structures under construction, and more particularly to apparatus and methods for simplifying the removal of a screw jack from a temporary support structure by reducing its load prior to disassembly.

In concrete construction a screw jack is used to support beams and columns in concrete forming systems while concrete is placed and curing. Screw jacks typically include an anchor bracket that bears on a concrete column or other suitable support and a jack head that engages part of the concrete form support structure. The screw jack may have a pivoting head to accommodate uneven conditions or sloping support structures. The pivoting head is joined to the support member by a screw that can be adjusted to plumb or level a concrete form or to provide a slight extension to accommodate varying construction site conditions. A nut on the screw bears on the anchor bracket and the portion of the screw below the nut extends through a hole in the bracket while the nut carries the bearing load to the bracket. After the concrete has set or has partially cured, the screw jack can not be removed until the load is reduced because the concrete is exerting a substantial load on the screw jack that makes turning the screw jack nut very difficult.

Thus, it is desirable to have an apparatus that can carry the loads of a concrete forming system and concrete, yet easily be removed from the forming system once the concrete has set or has partially cured.

SUMMARY OF THE INVENTION

The present invention enables the load on a screw jack to be removed before it is necessary to turn the nut on the screw jack that held the screw jack's head in place. The invention includes a sand jack for being disposed between a screw jack and a structural member to be temporarily supported, comprising: a box for sand, having a bottom and a side joined to the bottom; a sand port in the side of the box; a lid having a sand bearing plate at least partially disposed in the box; and a sand port cap releasably engaged to the sand port.

Another embodiment of a sand jack for being disposed between a screw jack and a structural member to be temporarily supported, includes: a box for sand, having a bottom and a side joined to the bottom; a sand port in the side of the box; a skirt joined to and extending outward from the box to define a screw jack receptacle; a lid having a sand bearing plate at least partially disposed in the box; a sand port cap releasably engaged to the sand port; and a hook temporarily engageable with a screw jack and the box.

The sand jack box side may include a plurality of plates. The sand jack sand port may include a pipe joined to the box around a hole in the side of the box.

The sand jack lid may include a substantially rectangular plate with at least one edge bent away from a structural member to be temporarily supported. The sand jack may have a fixed depth and the sand bearing plate of the lid has a depth greater than the depth of the box.

The sand jack may also include a tube joined to the box; a hook for temporarily engaging a screw jack; a tube joined to the hook; and a pin slidably disposed in the box tube and the hook tube when the tubes are aligned.

Also, in accordance with the present invention, there is a method for temporarily supporting a structural member with a screw jack, including the steps of: filling a box with sand; placing a lid bearing plate at least partially inside the box and on the sand; temporarily joining the box to a screw jack; temporarily supporting a structural member; and releasing sand from the box to reduce supporting load on the screw jack.

The method step of temporarily joining the box to the screw jack may include the steps of: inserting a portion of the screw jack in a skirt receptacle extending outwardly from the box; engaging a hook with the screw jack; and securing the hook to the box. The method step of releasing sand from the box may include the step of: opening a sand port in the box.

The method step of releasing sand from the box results in the lid bearing plate resting in the bottom of the box and a lid cover plate remaining above a side of the box.

DETAILED DESCRIPTION OF DRAWINGS

Figure 1:
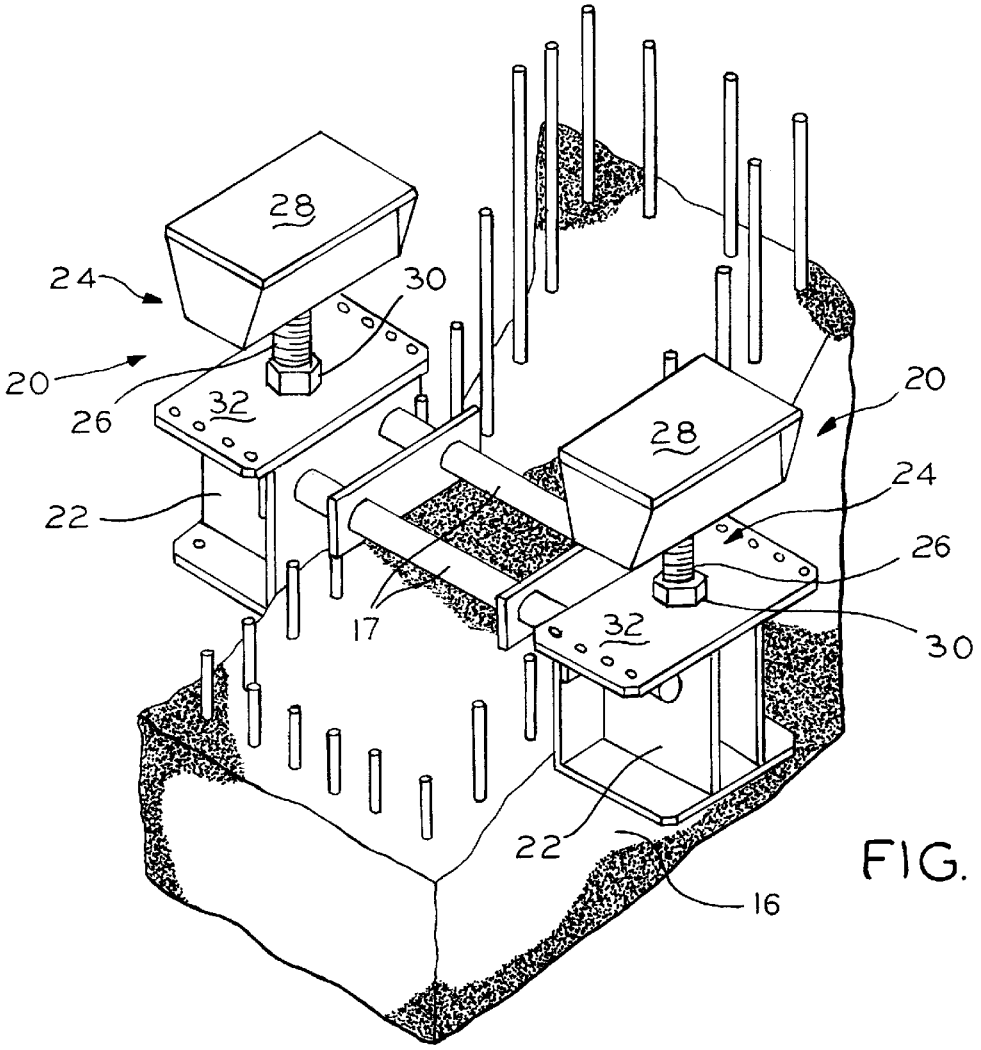
FIG. 1 is a perspective view of a pair of screw jacks joined to a concrete column with through bolts.

To the extent reasonable and practical, the same reference numerals will be used for the same or similar items depicted in each of the figures. Referring to FIG. 1, there is depicted a pair of jacking systems 20 bearing on a concrete column 16 (illustrated as partially broken away) for use in temporarily supporting a structure under construction. The jacking systems are tied together with through bolts 17. Each jacking system 20 includes an anchor bracket 22, and a screw jack 24 which includes a screw 26, a head 28, and a nut 30.

The anchor bracket 22 is illustrated as a short steel structural member, but it may be any practical length. The screw jack 24 head 28 may be fixed to the screw 26 or it may swivel for sloping conditions. The screws 26 are intended to adjust from between 10" and 15" above the top 32 of the anchor brackets 22. To adjust the length of a screw jack 24, the nut 30 is adjusted to bring the jack head 28 to the appropriate elevation and angle to support a concrete form.

Typically a number of screw jacks are used in any given construction situation to support things such as concrete form panels, spreader beams, or other temporary structures used in the erection of permanent structures. In the case of a concrete structure (FIG. 2), the screw jacks 24 will support a concrete form or spreader beam 34 while the concrete is being placed and is curing. Typically, when the concrete has cured and it is time to remove the temporary structure 34, the nut 30 is turned to reduce the load and pull the screw jack head 28 away from the form or spreader beam 34. However, with the load applied by the concrete it is difficult to turn the nut 30 and, occasionally excessive time and effort are necessary to strip the screw jacks 24.

Figure 2:
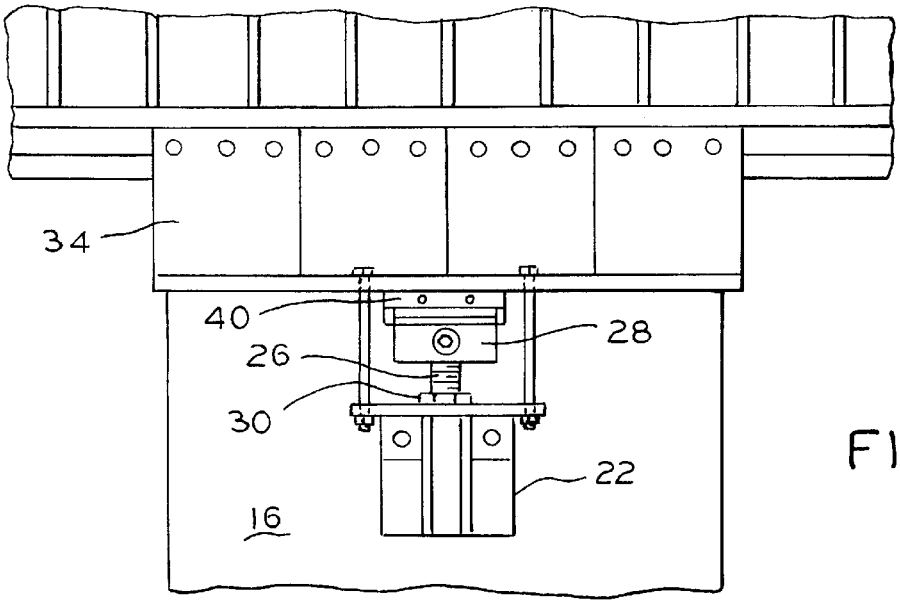
FIG. 2 is an elevation view of a screw jack and sand jack joined to a concrete column and supporting a beam.

As illustrated in FIG. 2, a sand jack 40 in accordance with the present invention is disposed between the screw jack head 28 and a structural member 36. The sand jack 40 is intended to provide adequate load bearing capacity for the structure under construction and yet provide easy means for reducing the load on the screw jack 24 and nut 30 after the permanent structure is capable of supporting itself.

Figure 3:
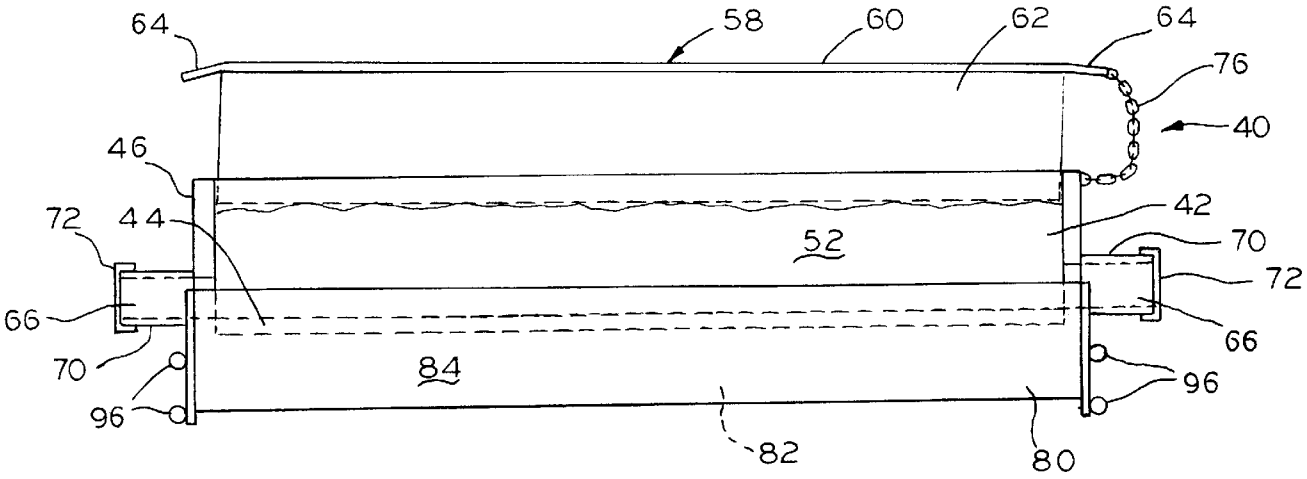
FIG. 3 is an elevation view of a sand jack in accordance with the present invention.
Figure 4:
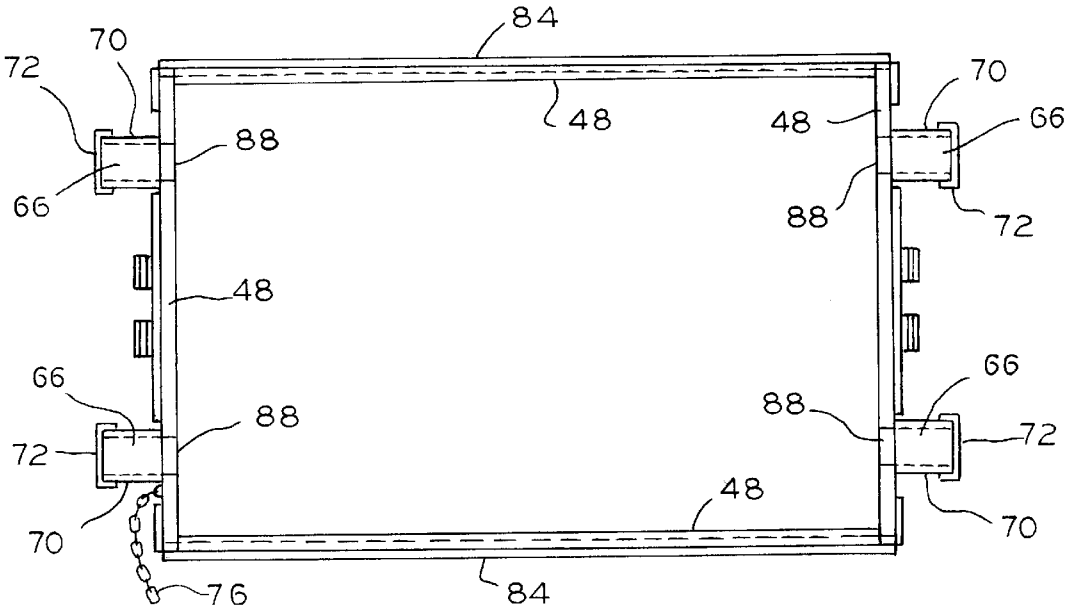
FIG. 4 is plan view of a sand jack box in accordance with the present invention.
Figure 5:
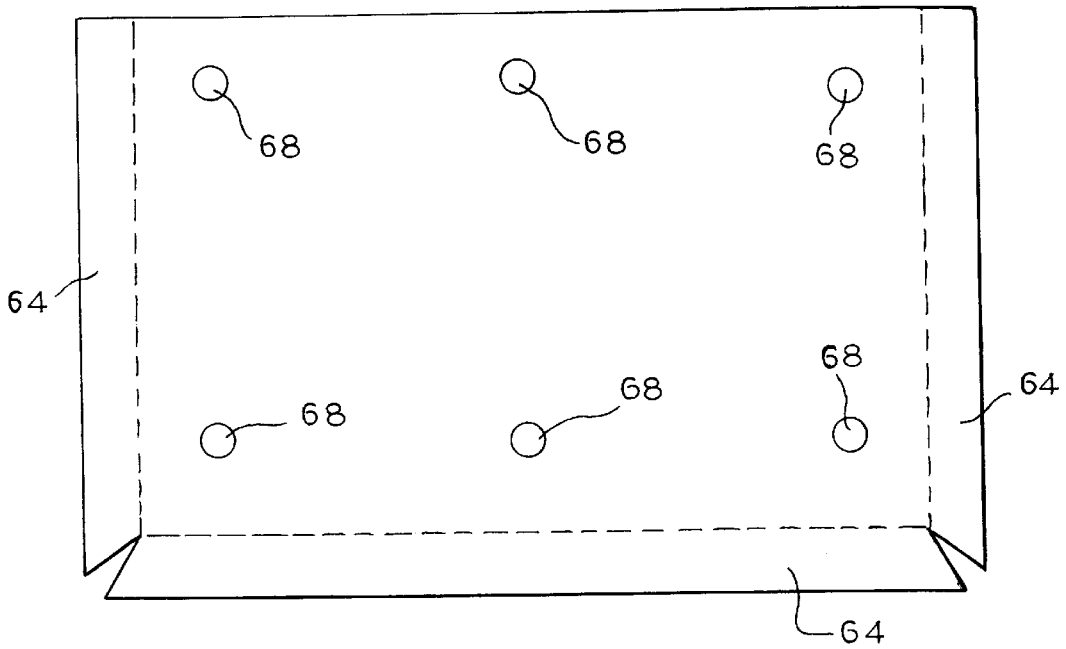
FIG. 5 is a plan view of a sand jack box lid.
Figure 6:
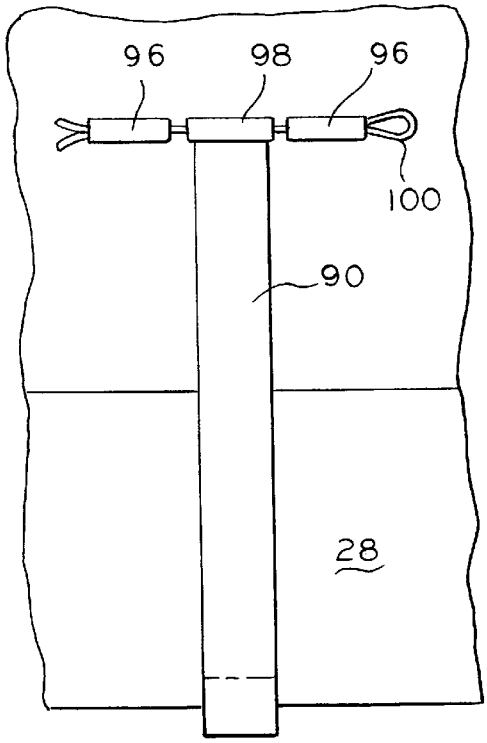
FIG. 6 is a hook secured to the sand jack to a screw jack.
Figure 7:
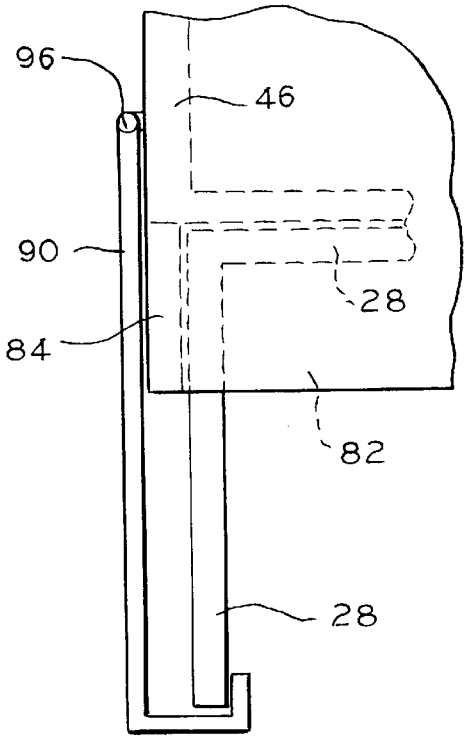
FIG. 7 is a side elevational view of the hook of FIG. 6.

Referring to FIGS. 3 to 5, the sand jack 40, includes a box 42 having a bottom 44 and a side 46 welded to the bottom 44. The side can include a plurality of rectangular plates 48 welded together in the shape of a rectangle, but the box 42 may be of any shape capable of holding sand 52 or other similar relatively non-compressible material. As used herein, the "term "sand" includes all such materials. The sand jack 40 also includes a lid 58 which includes a top plate 60 and a sand bearing plate 62. The top plate preferably includes at least one edge that is bent downward as illustrated, away from the structural member 34 so that water can drain away easily and not be trapped between the top plate 60 and the structural member 34. Welded to the bottom of the top plate 60 is the sand bearing plate 62 which is sized and shaped to fit within the box 42 and bear on the sand 52 contained within the box 42. Preferably, the top plate 60 is provided with a number of holes 68 (FIG. 5) in which plug welds can be applied to weld the top plate 60 to the sand bearing plate 62.

The box side 46 includes at least one sand port 66, but preferably several sand ports 66 through which sand 52 can be released from the box 42. The illustrated sand ports 66 include a hole 88 in the box side plates 48 and a short pipe section 70 welded to the box side plates 48 around the holes 68. A pipe cap 72 is screwed on to the outer end of the pipe section 70 to retain sand in the sand 52 in the box 42 until it is necessary to release the sand 52. A chain 76 is provided to ensure that the box 42 and the lid 58 do not become separated on a construction site.

Extending downward from at least two sides of the box 42 is a skirt 80 defining a receptacle 82 into which the screw jack head 28 is disposed. The skirt 80 includes a number of rectangular plates 84 that are welded to the box side 46 as illustrated. The skirt 80 fitted over the screw jack head 28 provides a convenient releasable bearing interface between the screw jack 24 and the sand jack 40 while also providing the security from the possibility that the sand jack 40 may slide sideways relative to the screw jack 24. To provide additional security against the sand jack 40 becoming dislodged from the screw jack 24 during construction, a hook 90 is provided which includes a lower "J" portion that engages the screw jack head 28 and is joined to the sand jack 40 in any suitable manner. One preferred manner for joining the hook 90 to the sand jack 40 is to include on the side of the box 42 or on the skirt 80 a pair of spaced apart tubes 96 welded to the skirt 80 so that they are aligned coaxially. A hook tube 98 is welded to the top end of the hook 90 and has a similar diameter as the skirt tubes 96 and is sized to fit between the spaced apart skirt tubes 96. Once the hook tube 98 and the box tubes 96 are aligned, a pin 100 such as a cotter pin, can be inserted through all three tubes to secure the hook 90 to the box 42. As illustrated, box tubes 96 are provided at a number of locations around the box 42 to provide convenient locations where hooks 90 can be secured to the box regardless of the size of the screw jack head 28 or the proximity of concrete form assemblies that may interfere with installation of hooks 90.

In use, a screw jack 24 is positioned at a construction site where a temporary concrete forming structure 34 will be erected. On top of the screw jack head 28 the sand jack 40 is positioned by inserting the screw jack head 28 into the receptacle 82 defined by the sand jack skirt 80. The sand jack 40 is secured to the screw jack head 28 using hooks 90 as described above. Sand 52 is then poured into the box 42 to a level below the top of the box side 46 so that the sand bearing plate 62 on the lid 58 can be disposed slightly into the box 42 where it will be restrained from lateral movement. After the sand jack 40 is in place, an appropriate structural member 36 is placed on top of the sand jack lid 58 to serve as a concrete form support member. After the concrete has been placed and has partially cured, and it is necessary to remove the jacking system 20 and related concrete form structural members 36, the sand 52 is removed from the box 42 by removing the pipe caps 72 so that sand will be released through the hole 68 and out the pipe section 70. As the sand pours out of the sand port 66, the lid 58 will drop downward and the sand bearing plate 62 will engage the sand jack box bottom 44 before the lid top plate 68 engages the side 46 of the box 42. This eliminates the possibility that the top plate 60 will be damaged by the box side 46 as the lid moves downward and is still carrying a significant load. To accomplish this, it is necessary to have a sand bearing plate 62 having a depth that is at least slightly greater then the depth of the sand jack box 42.

Once the sand 52 has been drained from the box 42, a significant amount of the load on the jacking system 20 has been reduced and the nut 30 on the screw jack 24 is much more easily turned to enable the screw jack screw to be lowered and the screw jack and anchor bracket can be removed and reused on another portion of the structure. It is to be understood that although the sand jack has been describe for use with sand, other types of non-compressible yet flowable can be used to the same effect.

The foregoing detailed description has been provided for clearness of understanding only, and no unnecessary limitations therefrom should be read into the following claims.

We claim:

1. A sand jack for being disposed between a screw jack and a structural member to be temporarily supported, comprising:

a box for receiving sand to a desired depth therewithin, the box having a bottom and a side joined to the bottom;

a sand port in the side of the box;

a lid having a sand bearing plate at least partially disposed in the box to rest upon and be supported by the sand within the box;

a sand port cap releasably engaged to the sand port for retaining sand within the box when the sand port cap is engaged with the sand port and for causing sand to be released from within the box when the sand port cap is released from the sand port; and a skirt joined to and extending downwardly from the box to define a screw jack receptacle for receiving a screw jack therewithin;

the sand bearing plate being laterally restrained within the box and movable downward toward the bottom of the box responsive to releasing the sand port cap from the sand port to cause sand to be released from within the box.

2. The sand jack of claim 1 in which the box side comprises:

a plurality of plates.

3. The sand jack of claim 1 in which the sand port comprises:

a pipe joined to the box around a hole in the side of the box.

4. The sand jack of claim 1 in which the lid comprises:

a substantially rectangular plate with at least one edge bent away from a structural member to be temporarily supported.

5. The sand jack of claim 1 in which the box has a fixed depth and the sand bearing plate of the lid has a depth greater than the depth of the box.

6. The sand jack of claim 1 and further comprising:

means for releasably engaging the sand jack to a screw jack.

7. The sand jack of claim 1 and further comprising:

a tube joined to the box;

a hook for temporarily engaging a screw jack;

a tube joined to the hook; and a pin slidably disposed in the box tube and the hook tube when the tubes are aligned.

8. A sand jack for being disposed between a screw jack and a structural member to be temporarily supported, comprising:

a box for sand, having a bottom and a side joined to the bottom;

a sand port in the side of the box;

a skirt joined to and extending outward from the box to define a screw jack receptacle;

a lid having a sand bearing plate at least partially disposed in the box;

a sand port cap releasably engaged to the sand port; and a hook temporarily engageable with a screw jack and the box.

9. The sand jack of claim 8 in which the box side comprises:

a plurality of plates.

10. The sand jack of claim 8 in which the sand port comprises:

a pipe joined to the box around a hole in the side of the box.

11. The sand jack of claim 8 in which the lid comprises:

a substantially rectangular plate with at least one edge bent away from a structural member to be temporarily supported.

12. The sand jack of claim 8 and further comprising:

a pair of spaced apart box tubes joined to the box and having bores that are substantially longitudinally aligned;

a hook tube joined to the hook and sized to fit between the box tubes for a longitudinal lignment therewith; and a pin slidably inserted in the box tubes and the hook tube to temporarily engage the hook and box.

13. The sand jack of claim 8 in which the box has a fixed depth and the sand bearing plate of the lid has a depth greater than the depth of the box.

* * * * *

UNITED STATES PATENT AND TRADEMARK OFFICE

CERTIFICATE OF CORRECTION

PATENT NO. : 5,816,562
DATED : October 6, 1998
INVENTOR(S) : Stockton et al.

It is certified that error appears in the above-identified patent and that said Letters Patent is hereby corrected as shown below:

Title page,
Column 1, under "U.S. PATENT DOCUMENTS", please delete "Scheulen" and insert in its place -- Schueler --.

Column 3,
Line 12, please delete ""term"" and insert in its place -- term --.

Signed and Sealed this

Eighteenth Day of December, 2001

*Attest:*

*Attesting Officer*

JAMES E. ROGAN
*Director of the United States Patent and Trademark Office*